United States Patent [19]

Dugge

[11] 4,428,585

[45] Jan. 31, 1984

[54] PERMEABLE MEMBRANE SEAL ASSEMBLY

[75] Inventor: Richard H. Dugge, St. Louis, Mo.

[73] Assignee: ACF Industries, Incorporated, New York, N.Y.

[21] Appl. No.: 369,044

[22] Filed: Apr. 16, 1982

[51] Int. Cl.[3] ..... B61D 7/22; F16J 15/06

[52] U.S. Cl. ..... 277/12; 277/27; 277/58

[58] Field of Search ..... 277/12, 27, 58, 192

[56] References Cited

U.S. PATENT DOCUMENTS 4,280,706 7/1981 Vorwerk ..... 277/12

*Primary Examiner*—Robert I. Smith

*Attorney, Agent, or Firm*—Henry W. Cummings

[57] ABSTRACT

A permeable membrane seal (10) includes a body portion (12) made of elastomeric material. The body portion includes an elongated slot (18) to receive a permeable membrane (20). The membrane is held in place with stitches of thread (22) sewn at about 90° to the seal body portion. The stitched threads substantially prevent a flow path of fluidizing air from the permeable material outwardly to either side of the elastomeric body portion. Mechanical fasteners (44) located outboard of the stitches hold the reinforced elastomeric body portion in place between a hopper mounting flange and an outlet mounting flange. Optional fabric reinforcement increases the tensile strength of the elastomeric material to better withstand the membrane pressure load applied by the fluidizing media. The fabric reinforcement (14) is preferably molded integral with the elastomeric material.

17 Claims, 3 Drawing Figures

PERMEABLE MEMBRANE SEAL ASSEMBLY

BACKGROUND OF THE INVENTION

In U.S. Pat. Nos. 3,226,166, 4,015,751 and 4,280,706 permeable membranes are held in place in pneumatic outlets with mechanical fasteners extending through the permeable membrane and through abutting flanges located on either side of the permeable membrane. Since a fluid medium such as air can pass through the membrane in a direction both perpendicular to the membrane and parallel to or longitudinally of the membrane, the mechanical fastener openings provide a leak path for fluid media through one or both of the flange openings.

To reduce this tendency in one construction the flange portion of the permeable membrane has been painted with a urethane coating in an effort to reduce the flow of fluid media outwardly through the membrane flange portion. However, this has still not reduced flow of fluid media through the flange portion to the extent desired.

The object of the invention is to provide a permeable membrane seal assembly which greatly reduces or eliminates the escape of fluid media through the flange portion of the permeable membrane.

SUMMARY OF THE INVENTION

A permeable membrane seal includes a body portion made of elastomeric material. The body portion includes an elongated slot to receive the permeable membrane. The membrane is held in place with stitches of thread which preferably also extend through the seal. The stitches of threads substantially prevent a flow path of fluidizing air from the permeable material outwardly to either side of the elastomeric body portion. Mechanical fasteners located outboard of the stitches hold the elastomeric body portion in place between a hopper mounting flange and an outlet mounting flange.

Preferably the elastomeric material is reinforced with at least one layer of fabric, preferably molded integral with the elastomeric material. Preferably, at least a pair of fabric reinforcements are provided extending through the body portion and above and below the slot.

The fabric reinforcement increases the tensile strength of the elastomeric material to better withstand the membrane pressure load applied by the fluidizing media.

The seal assembly is also applicable to sealing a permeable membrane used in other applicators such as in a filter assembly.

In the Drawings

DESCRIPTION OF PREFERRED EMBODIMENTS

Figure 2:
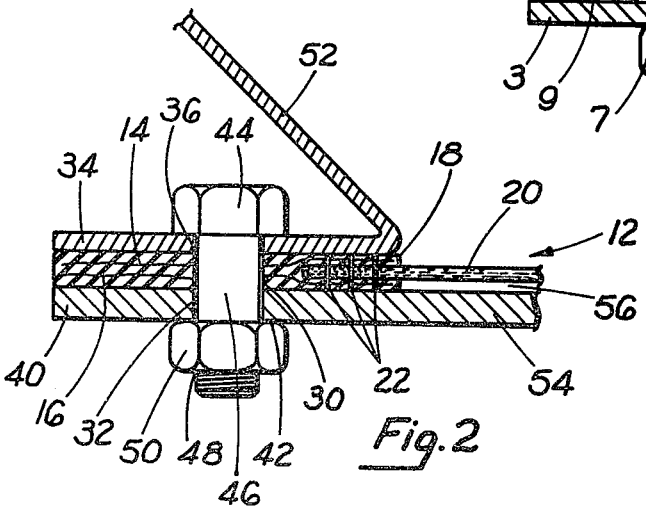
FIG. 2 is a vertical sectional view illustrating the seal member of FIG. 1 located within a pneumatic outlet.

The seal assembly of the present invention is indicated in the drawings generally at 10. The seal assembly includes an elastomeric body portion indicated generally at 12. Elastomeric body portion 12 is generally rectangular in cross section as shown in FIG. 2. The body portion includes at least one and preferably a pair of fabricated reinforcements 14 and 16 molded integral with the body portion and extending throughout a substantial distance of the long dimension of the rectangle. The body portion 12 includes an elongated slot 18 which receives a permeable membrane 20. Preferably one of the fabric reinforcements 14 and 16 extends in the body portion above the slot 18 and preferably another of the fabric reinforcements 14 and 16 extends in the body portion below the elongated slot 18. A plurality of stitches 22 are provided which hold the permeable membrane in place within the body portion slot 18 and which also preferably extend through the fabric reinforcements 14 and 16 to provide an integral connection of the permeable membrane with the elastomeric body portion 12.

Many more stitches 22 can be provided than could for example countersunk mechanical fasteners. Furthermore there is much less clearance between the stitches and the elastomeric body portion than would be the case if a countersunk fastener were utilized. Thus the path of fluidizing media out of the fluidizing media along the stitches 22 is very minimal in contrast to the flow rate which would be present if countersunk fasteners were used. Furthermore, the elastomeric body portion essentially prevents any flow of fluidizing media out through the end portion parallel to the permeable membrane.

In the embodiment shown the elastomeric body portion is a four-sided member including a relatively short side 22', a pair of inclined sides 24 and 26, and a long side 28.

Inboard of the elongated slot openings 30 are provided in the body portion to receive mechanical fasteners 32 to hold the elastomeric seal in place within a first flange 34 having a fastener opening 36 and a second flange 40 having a fastener opening 42. Preferably the fastener has a fastener head 44, a shank 46 and a threaded portion 48 upon which is located a threaded nut 50.

In the preferred embodiment of the present invention, the flange 34 is part of a hopper slope sheet 52, and may be a bent extension thereof or may be welded to the hopper slope sheet. Also in the preferred embodiment, the flange portion 40 is part of a plennum plate 54 utilized to form a plennum chamber 56 between the plennum plate 54 and the permeable membrane 20. Fluidizing medium is applied to the plennum plate 54 through the conduit 56. U.S. Pat. No. 4,280,706, hereby incorporated into the present application by this reference, describes a pneumatic outlet which may be fluidized with the permeable membrane assembly of the present invention.

However, it is to be born in mind that the construction shown in FIG. 2 including flange portions 34 and 40, body portion 12, reinforcements 14 and 16, permeable membrane 20 held in place within slot 18 with stitched threads 22, may be utilized to effectively seal the periphery of any permeable membrane. Such permeable membranes are commonly utilized not only in pneumatic vehicle outlets, but also in filter assemblies for example, and it is to be within the preview of the present invention to include such additional applications.

Figure 1:
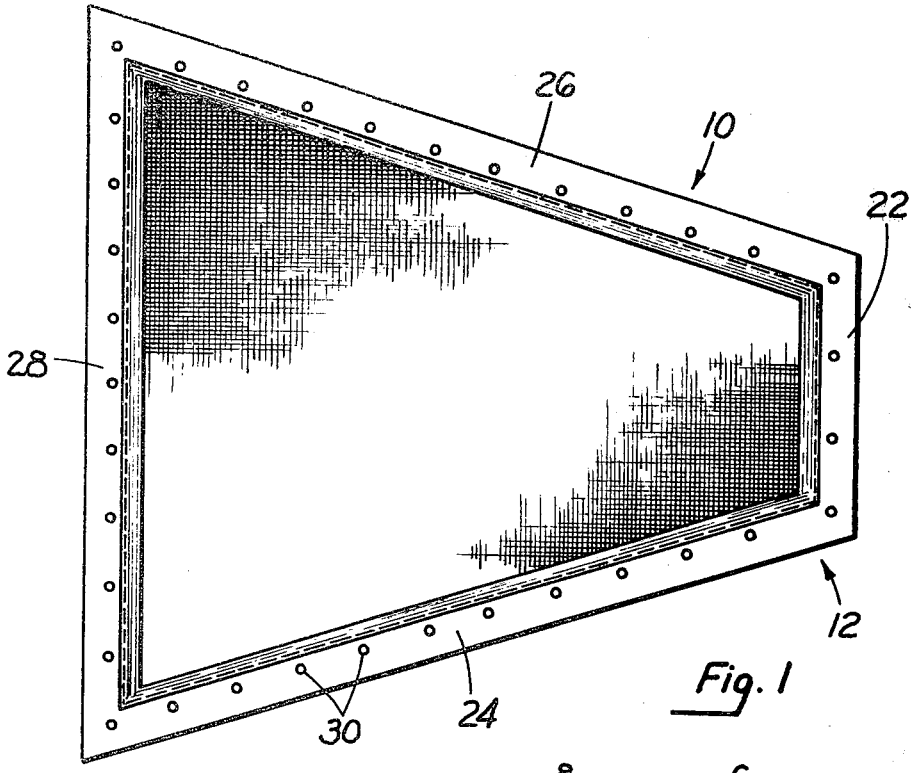
FIG. 1 is a plan view of the seal member of the present invention.
Figure 3:
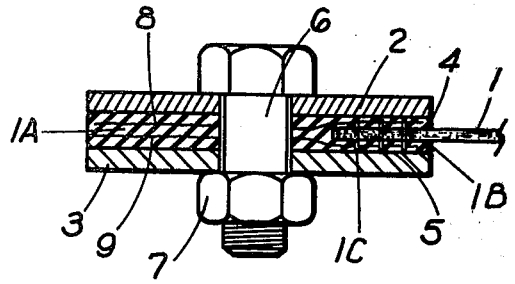
FIG. 3 is a vertical sectional view of another embodiment wherein said seal is used in a filter.

In another embodiment of the present invention, particularly adopted for filter assemblies, a permeable membrane which extends into a seal member 1A has a slot therein **1*b*. A plurality of stitches or threads 1C** hold the permeable membrane integral with the seal member 1A. The seal member is held in place between filter mounting flanges 2 and 3 by means of a mechanical fastener 6 and a threaded nut 7. A fluid medium M to be filtered passes through the permeable membrane which have particles of a desired size are removed. The stitches 1C significantly reduce the extent to which fluid medium losses occur in this filter assembly. Reinforcements for the seal body portions 8 and 9 are also provided. The shape of the filter assembly shown in FIG. 3 may have the same shape as the assembly 10 in FIG. 1, and may be rectangular or any desired shape.

Furthermore, the reinforcements 8 and 9 provide an elastomeric seal of improved tensile strength to withstand the membrane loads applied by the fluid medium when the assembly is pressurized.

The permeable membrane may be a polypropylene felt material obtaintable from National Filter Corporation, Moorestown, N.J.

The fabric reinforcements may comprise nylon, cotton, rayon, Kevlar, registered trademark of E. I. DuPont Nemours, Wilmington, Del. Other high strength fabric materials also may be utilized.

The threads are preferably nylon, polypropylene or other high strength material.

The elastomeric body portion 1A, 12 may be made of known elastomeric materials, preferably a durometer value of 40 to 60 A scale is preferred.

For use in a pneumatic outlet, the permeability of the permeable membrane 20 preferably is from 5 to 10 cubic feet per minute per square inch at a 2" of water pressure drop. For an air filter applicator 5 to 50 CFM may be used.

For an example, the permeable membrane seal assembly of the present invention may be utilized in place of the seal assembly utilized in U.S. Pat. No. 4,280,706, hereby incorporated into the present application by this reference. As will be apparent from FIG. 1 of this patent, a pair of such seal assemblies will be required to seal both sides of the fluidizing outlet assembly 10.

What is claimed is:

1. A permeable membrane seal comprising: a body portion made of elastomeric material; said body portion including an elongated slot to receive a permeable membrane; said membrane held in place with stitches of threads which extend through the body portion and permeable membrane; whereby said stitched threads substantially prevent a flow path of fluidizing media from the permeable material vertically and said elastomeric body portion prevents a flow of fluidizing media laterally through said body portion.

2. A permeable membrane seal according to claim 1, including at least a pair of fabric reinforcements each respectively located in said body portion above and below said slot.

3. A permeable membrane seal according to claim 2, including fastening means located outboard of the stitches which hold the reinforced elastomeric body portion in place between a pair of opposed mounting flanges.

4. A permeable membrane seal comprising: a body portion made of elastomeric material; at least one layer of fabric reinforcement extending throughout a substantial portion of said rectangular body portion and molded integral with the elastomeric material; said body portion including an elongated slot to receive a permeable membrane; said membrane held in place with stitches of threads which extend through said body portion, said permeable membrane and said fabric reinforcement; whereby said fabric reinforcement increases the tensile strength of the elastomeric material to better withstand membrane pressure loads applied by the fluidizing media and said stitched threads by interlocking with fabric reinforcement secures the permeable membrane to the elastomeric material to substantially prevent a flow path of fluidizing media laterally from the permeable material and out through the elastomeric body portion.

5. A permeable membrane seal according to claim 4, wherein said threads are formed from nylon, cotton and polypropylene thread material.

6. A permeable membrane seal according to claim 5, wherein said fabric reinforcements are selected from nylon, cotton and rayon materials.

7. A permeable membrane seal according to claim 6, wherein said elastomeric material has a durometer value of 40 to 60.

8. A permeable membrane seal comprising: a body portion made of elastomeric material and having a generally rectangular cross section; at least a pair of layers of fabric reinforcement extending throughout a substantial portion of the longer dimension of said rectangular body portion and molded integral with the elastomeric material; said body portion including an elongated slot to receive a permeable membrane; one of said reinforcements located above said slot and one reinforcement located below said slot; said membrane held in place with stitches of threads which extend through said fabric reinforcements; whereby said fabric reinforcements increase the tensile strength of the elastomeric material to better withstand membrane pressure loads applied by the fluidizing media, and said stitched threads substantially prevent a flow path of fluidizing media vertically from the permeable material, and said elastomeric material prevents flow laterally out through the elastomeric body portion.

9. A permeable membrane seal according to claim 8, including fastening means located outboard of the stitches which hold the reinforced elastomeric body portion in place between a pair of opposed mounting flanges.

10. A permeable membrane seal according to claim 9, wherein said seal has four sides.

11. A permeable membrane seal according to claim 10, wherein said seal is mounted in a pneumatic outlet.

12. A permeable membrane seal according to claim 11, wherein one of said mounting flanges is connected to a hopper and the other mounting flange is connected to an outlet pan.

13. A permeable membrane seal according to claim 12, wherein said outlet pan in part defines a plenum chamber.

14. A permeable membrane seal according to claim 8, wherein said seal is used in a filter assembly.

15. A pneumatic outlet comprising: a hopper member having an inclined slope sheet portion extending inwardly and downwardly, and a flange portion extending outwardly therefrom; an outlet pan spaced below said hopper member; a seal member located between said hopper member and said pan; said seal including an elongated slot; said permeable membrane being held within said seal member be means of stitches and/or threads extending generally perpendicular to said permeable membrane thereby substantially preventing the flow of fluid medium outwardly through said seal.

16. A pneumatic outlet according to claim 15, wherein said seal member includes reinforcing means to improve the tensile strength of said seal.

17. A pneumatic outlet according to claim 16, wherein said reinforcing means comprise a fabric and wherein said fabric extends on either side of said elongated slot.

* * * * *